US008888103B1

(12) United States Patent
Long

(10) Patent No.: US 8,888,103 B1
(45) Date of Patent: Nov. 18, 2014

(54) GAME APPARATUS AND METHOD

(71) Applicant: Travis B. Long, Athens, TX (US)

(72) Inventor: Travis B. Long, Athens, TX (US)

( * ) Notice: Subject to any disclaimer, the term of this patent is extended or adjusted under 35 U.S.C. 154(b) by 0 days.

(21) Appl. No.: 14/156,198

(22) Filed: Jan. 15, 2014

Related U.S. Application Data

(60) Provisional application No. 61/848,946, filed on Jan. 17, 2013.

(51) Int. Cl.
*A63B 71/04* (2006.01)
*A63F 7/02* (2006.01)

(52) U.S. Cl.
CPC ..... *A63F 7/02* (2013.01)
USPC ..... 273/355; 124/4

(58) Field of Classification Search
USPC ..... 273/355–357, 399; 124/4, 6
See application file for complete search history.

(56) References Cited

U.S. PATENT DOCUMENTS 310,388 A * 1/1885 Dealy ..... 273/355
731,850 A * 6/1903 Bradbury ..... 273/355
1,260,026 A * 3/1918 Peacock ..... 273/355
1,525,588 A * 2/1925 Moore ..... 124/79
1,531,105 A * 3/1925 Knowlton ..... 124/4
1,576,515 A * 3/1926 Kinney ..... 273/399
2,146,156 A * 2/1939 Nicot et al. ..... 124/4
2,520,460 A * 8/1950 Ford ..... 124/7
3,075,764 A * 1/1963 De Lorean ..... 482/31
3,669,451 A * 6/1972 Welbourn ..... 273/412
3,794,325 A * 2/1974 Stender ..... 273/399
4,010,953 A * 3/1977 Russo ..... 273/317.3
4,529,207 A * 7/1985 Iseki et al. ..... 273/357
5,344,156 A * 9/1994 Levin ..... 273/355
7,591,471 B2 * 9/2009 Walterscheid ..... 273/348.3
7,631,876 B1 * 12/2009 Walterscheid ..... 273/348.3
8,387,988 B2 * 3/2013 Van Ness ..... 273/357

* cited by examiner

*Primary Examiner* — Mark Graham
(74) *Attorney, Agent, or Firm* — Kenneth L Tolar

(57) ABSTRACT

A game apparatus includes a base panel having a narrow first end and a wide-profile opposing end surrounded by a continuous, vertical retaining wall that encompasses a plurality of semispherical cavities. Adjacent each cavity is a numeral corresponding to a score value that is added to a current cumulative score whenever a player's marble lands within a cavity. Using a catapult mechanism, each player sequentially propels a marble toward the cavities. The player having the highest cumulative score after a requisite number of launches wins the game.

5 Claims, 2 Drawing Sheets

GAME APPARATUS AND METHOD

CROSS REFERENCE TO RELATED APPLICATIONS

This application is entitled to the benefit of provisional patent application No. 61/848,946 filed on Jan. 17, 2013, the specification of which is incorporated herein by reference.

BACKGROUND OF THE INVENTION

The present invention relates to a game wherein players alternate propelling a marble toward a target area containing multiple, numbered cavities to achieve a cumulative score.

DESCRIPTION OF THE PRIOR ART

Though numerous children's games exist in the prior art, most are marginally educational. Conversely, children are rarely motivated to play educational games since most are monotonous or mundane. Accordingly, there is currently a need for an educational game that is both challenging and interesting. The present invention addresses this need by providing a game apparatus whereby players alternate propelling a marble toward a plurality of cavities. Whenever a player's marble lands within a cavity, an adjacent numerical value is added to a previous total until a requisite number of launches have been completed. The player having the highest cumulative score wins the game.

SUMMARY OF THE INVENTION

A game apparatus includes a base panel having a narrow first end and a wide-profile opposing end surrounded by a continuous, vertical retaining wall. The retaining wall encompasses a target area having a plurality of semispherical, spaced cavities. Adjacent each cavity is a numeral corresponding to a score value that is added to a current cumulative score whenever a player's marble lands within a cavity. Using a catapult mechanism at an opposing end of the base panel, each player sequentially propels a marble toward the target area where it eventually rests within one of the cavities. The number adjacent the cavity is added to a previous score to calculate a cumulative score. The player having the highest cumulative score after a requisite number of launches wins the game.

It is an object of the present invention to provide an entertaining game apparatus.

It is another object of the present invention to provide a game apparatus that is both challenging and educational. Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
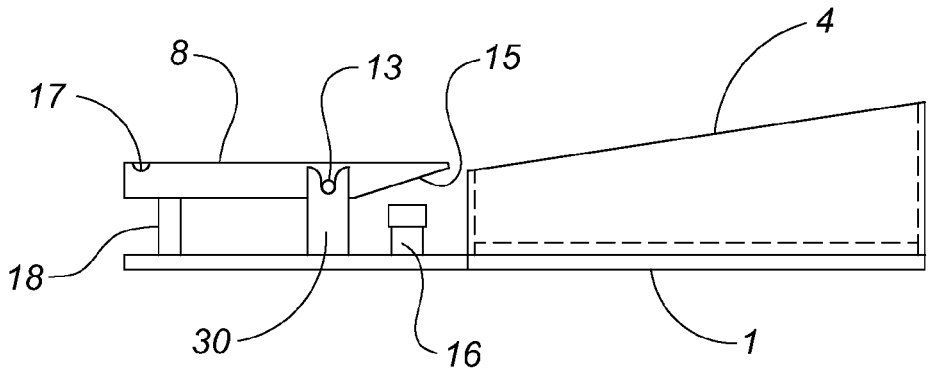
FIG. 1 is a side view of the game apparatus according to the present invention with the launch arm in an idle position.
Figure 2:
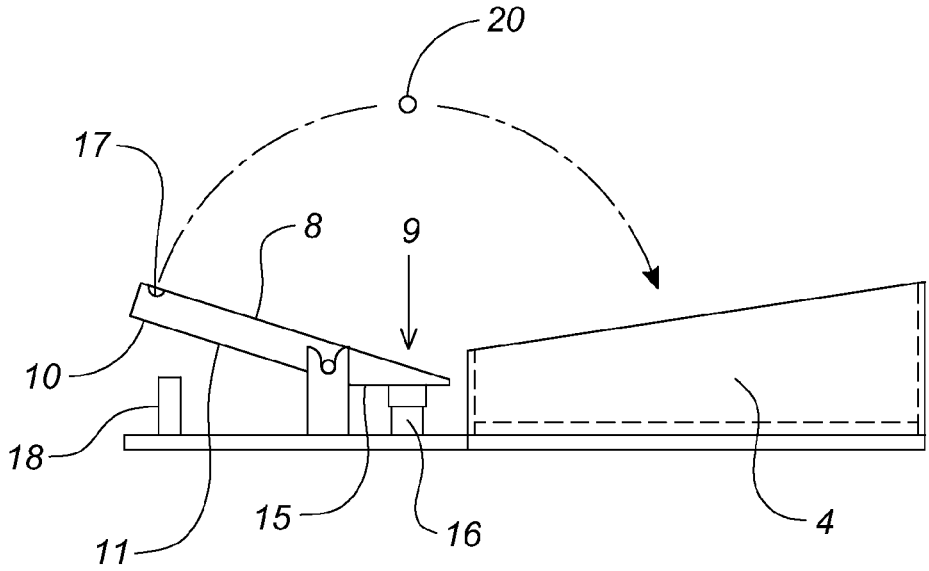
FIG. 2 is a side view of the game apparatus with the arm in an active position.
Figure 3:
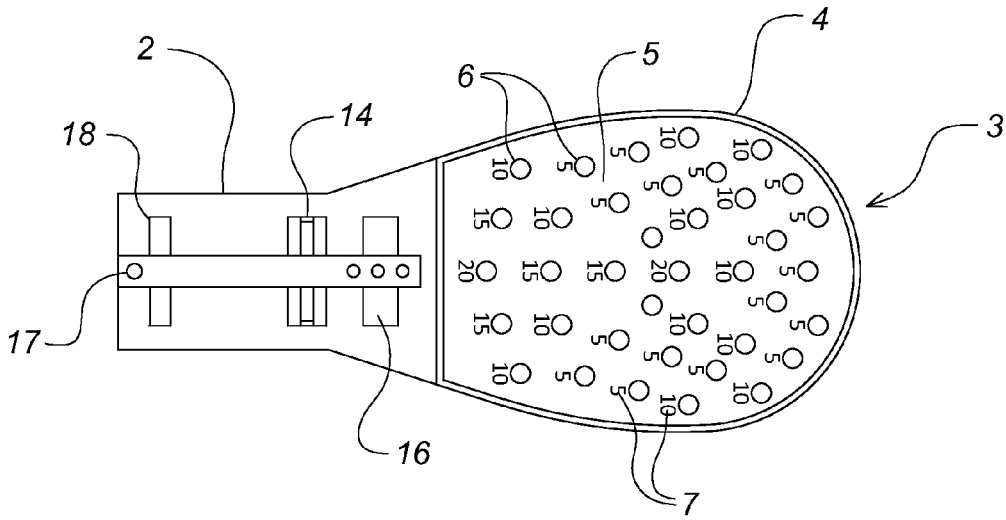
FIG. 3 is a top view of the game apparatus.
Figure 4:
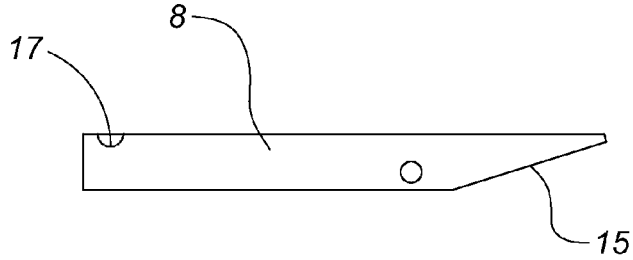
FIG. 4 is an isolated, side view of the launch arm.
Figure 5:
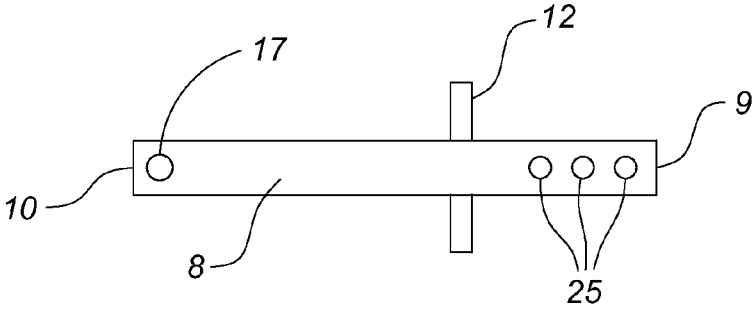
FIG. 5 is an isolated, top view of the launch arm.

The present invention relates to a game apparatus and method for enhancing a child's mathematical skills. The apparatus comprises a base panel 1 having an upper surface, a narrow first end 2 and a wide-profile opposing end 3 surrounded by a continuous, vertical retaining wall 4. The retaining wall encompasses a target area 5 having a plurality of semispherical cavities 6 formed thereon. Adjacent each cavity is a numeral 7 corresponding to a score value that is added to a current cumulative score whenever a player's marble 20 lands within a cavity.

Positioned on the narrow end of the base panel is a catapult mechanism for propelling a marble toward the target area. The mechanism is formed of a pivotal launch arm 8 having a first end 9, an opposing second end 10 and an intermediate portion with a spindle 12 mounted thereon. A fulcrum 14 positioned includes a pair of spaced walls 30, each having a groove 13 at an upper distal end that receives the spindle 12 to allow the arm to reciprocate in a seesaw-type fashion. Downward movement of the first end 9 of the arm is limited by an angled bottom surface 15 that selectively engages an underlying bumper 16. Proximal the second end of the arm is a receptacle 17 for retaining a marble when the arm is idling on a support block 18. Color-coded dots 25 above the angled surface provide multiple targets for a player's finger to vary the upward launch force applied to the marble.

Accordingly, each player sequentially places a marble within the receptacle 17 and thrusts the angled first end 9 of the arm downwardly. The marble is propelled toward the target area where it eventually rests within one of the cavities 6. The number 7 adjacent the cavity represents the value of an initial score, if the launched marble was the player's first in a given game, or is added to a previous score to calculate a cumulative total. The player having the highest cumulative score after a requisite number of launches wins the game.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A game apparatus comprising:

a base panel having an upper surface, a narrow end and a wide-profile opposing end, said wide-profile opposing end surrounded by a continuous, vertical retaining wall, said retaining wall encompassing a target area having a plurality of semispherical cavities formed thereon;

a numeral adjacent each cavity corresponding to a score value;

a catapult mechanism positioned on the narrow end of the base panel for propelling a marble toward the target area and into a destination cavity whereby the numeral adjacent to the destination cavity is added to a current cumulative score to calculate a total score, wherein said catapult mechanism includes a pivotal launch arm having a first end and an opposing second end with an intermediate portion therebetween;

color-coded dots at the first end of said launch arm for providing multiple impact targets for a player's finger to vary the upward launch force applied by the second end to the marble.

2. The game apparatus according to claim 1 wherein said catapult mechanism further comprises:

a fulcrum positioned on a first end of said base panel, said fulcrum having a pair of spaced walls, each of said walls having a groove at an upper distal end;

a transverse spindle on the intermediate portion of said launch arm, said spindle resting in the groove on each of said spaced walls to allow the arm to reciprocate in a seesaw-type fashion; and a receptacle proximal the second end of the arm for retaining a marble whereby downward pressure applied to the first end of the arm propels said marble upwardly and onto the target area.

3. The game apparatus according to claim 1 wherein the first end of said launch arm includes an angled bottom surface that selectively engages an underlying bumper to limit downward movement of the first end of the arm.

4. The game apparatus according to claim 1 further comprising a support block beneath the second end of said arm for supporting said arm in a horizontal, idle position.

5. A game apparatus comprising:

a base panel having an upper surface, a narrow end and a wide-profile opposing end, said wide-profile opposing end surrounded by a continuous, vertical retaining wall, said retaining wall encompassing a target area having a plurality of semispherical cavities formed thereon;

a numeral adjacent each cavity corresponding to a score value;

a catapult mechanism positioned on the narrow end of the base panel for propelling a marble toward the target area and into a destination cavity whereby the numeral adjacent to the destination cavity is added to a current cumulative score to calculate a total score, wherein said catapult mechanism includes a fulcrum positioned on a first end of said base panel, said fulcrum having a pair of spaced walls, each of said walls having a groove at an upper distal end, a pivotal launch arm having a first end and an opposing second end with an intermediate portion therebetween, and a transverse spindle on the intermediate portion of said launch arm, said spindle resting in the groove on each of said spaced walls to allow the arm to reciprocate in a seesaw-type fashion, and a receptacle proximal the second end of the arm for retaining a marble whereby downward pressure applied to the first end of the arm propels said marble upwardly and onto the target area;

color-coded dots at the first end of said launch arm for providing multiple impact targets for a player's finger to vary the upward launch force applied by the second end to the marble.

* * * * *